US008857873B2

(12) United States Patent
Reger

(10) Patent No.: US 8,857,873 B2
(45) **Date of Patent: *Oct. 14, 2014**

(54) SYNTHETIC FIBER SLING AND ROLLER SYSTEM FOR CARRYING AND POSITIONING A LOAD

(71) Applicant: Robert J. Reger, Grand Island, NY (US)

(72) Inventor: Robert J. Reger, Grand Island, NY (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/870,060

(22) Filed: Apr. 25, 2013

(65) Prior Publication Data

US 2013/0234459 A1 Sep. 12, 2013

Related U.S. Application Data

(63) Continuation of application No. 12/802,277, filed on Jun. 3, 2010, now Pat. No. 8,434,799.

(51) Int. Cl.
*B66C 1/12* (2006.01)
*B66C 1/10* (2006.01)
*B66C 1/16* (2006.01)

(52) U.S. Cl.
CPC ... *B66C 1/12* (2013.01); *B66C 1/10* (2013.01); *B66C 1/16* (2013.01); *B66C 1/108* (2013.01)
USPC ..... 294/74; 294/82.12

(58) Field of Classification Search
CPC ..... B66C 1/108; B66C 1/12; B66C 1/16
USPC ..... 294/74, 81.3, 81.55, 81.56, 82.11, 294/82.12, 67.4, 67.5
See application file for complete search history.

(56) References Cited

U.S. PATENT DOCUMENTS

| | | | | | |
|---|---|---|---|---|---|
| 897,040 | A | * | 8/1908 | Wash | 294/81.1 |
| 2,020,306 | A | * | 11/1935 | Fitch | 294/81.3 |
| 2,244,533 | A | * | 6/1941 | Fletcher | 294/74 |
| 2,492,172 | A | * | 12/1949 | Morris | 294/74 |
| 3,582,125 | A | * | 6/1971 | Collins | 294/74 |
| 3,602,544 | A | * | 8/1971 | Marsh | 294/74 |
| 3,655,068 | A | * | 4/1972 | Ervin | 414/780 |
| 3,663,051 | A | * | 5/1972 | Yu | 294/81.5 |
| 3,709,548 | A | * | 1/1973 | Hogshead | 294/74 |
| 3,747,877 | A | * | 7/1973 | Drew | 244/139 |
| 4,019,770 | A | * | 4/1977 | Poelma et al. | 294/82.12 |
| 4,525,007 | A | * | 6/1985 | Chapalain | 294/74 |
| 4,700,433 | A | * | 10/1987 | Simon | 24/68 B |
| 4,762,355 | A | * | 8/1988 | Hogg | 294/82.12 |
| 4,850,629 | A | * | 7/1989 | St. Germain | 294/74 |
| 5,058,243 | A | * | 10/1991 | Rasmussen | 24/68 R |
| 5,492,383 | A | * | 2/1996 | Kentner, Sr. | 294/74 |

(Continued)

*Primary Examiner* — Dean Kramer
(74) *Attorney, Agent, or Firm* — Jacox, Meckstroth & Jenkins

(57) ABSTRACT

A sling system comprises a plurality of sling units each including a synthetic fibrous sling and a roller unit which has one or more spool-shaped rollers. The system provides for lifting a load in equilibrium and maintaining the load in that position or be rotated or tilted between horizontal and vertical positions. The system provides for a plurality of attachment points of the sling units to the load, and the sling units may be set up as a single array or a multiple array depending on the type of load being lifted, transported and positioned. Endless and continuous loop synthetic slings and multiple roller units are used in sling units and provide for uniform and equal distribution of the load throughout the sling system. The spool-shaped rollers may be molded of a rigid plastics material with each roller having end flanges to confine the synthetic sling.

9 Claims, 5 Drawing Sheets

(56) References Cited

U.S. PATENT DOCUMENTS

| | | | | |
|---|---|---|---|---|
| 5,836,631 | A * | 11/1998 | Coe | 294/74 |
| 5,836,632 | A * | 11/1998 | Pompa | 294/82.12 |
| 5,927,780 | A * | 7/1999 | Chandler | 294/82.11 |
| 6,508,051 | B1 * | 1/2003 | De Angelis | 57/223 |
| 6,543,826 | B1 * | 4/2003 | Aston | 294/74 |
| 7,658,423 | B1 * | 2/2010 | Carmichael | 294/74 |
| 7,661,737 | B2 * | 2/2010 | St. Germain | 294/74 |
| 7,669,904 | B1 * | 3/2010 | Carmichael | 294/74 |
| 8,434,799 | B2 * | 5/2013 | Reger | 294/74 |

* cited by examiner

SYNTHETIC FIBER SLING AND ROLLER SYSTEM FOR CARRYING AND POSITIONING A LOAD

RELATED APPLICATION

This application is a continuation of U.S. patent application Ser. No. 12/802,277, filed Jun. 3, 2010.

BACKGROUND OF THE INVENTION

When performing a lift in the hoisting and rigging industry, it is often desired that the load be in equilibrium so that each connection point at the load carry an equal part of the weight at all times to prevent overloading of the lifting components or prevent undesirable stresses on the load. In some applications, not only is it necessary to keep the load points in equilibrium, it is necessary to rotate or tilt the load from a horizontal position to a vertical position. Commonly, this task is accomplished by using wire rope or cable slings and large metal pulleys. In order to maintain the wire cable capacity, the ratio between the diameter and type of cable and the diameter of the pulley is referred to as a D/d ratio where "D" is the diameter of the pulley and the "d" is the diameter of the cable. By international standards for existing technology, this ratio ranges from 12-15. For example, a one inch diameter cable would require a pulley having a minimum diameter of twelve inches. Wire cables and their associated pulleys are commonly made of steel or some other metal which results in the cables and pulleys being extremely heavy and cumbersome. One form of cable and pulley rigging system is produced by Meadow Burke and illustrated on their website of Meadow-Burke.com.

Multi-strand synthetic fiber slings are commonly manufactured in two styles. In an eye to eye style, the sling is made with a continuous fiber core, and at each end the fibers are equally split, placed in a protective cover and sewn together. A continuous loop style is made similar, but the fibers are separated for the entire loop, creating a continuous endless loop, and the fibers are placed within a protective sleeve. Both of these styles are usually made in two different configurations, either single path or twin path. The single path has one or several continuous fibers looping around for a predetermined number of times depending on the required strength. The twin path has two separate paths of one or more continuous loops in isolated paths, and a protective cover is sewn lengthwise around the twin paths.

Flat type synthetic slings are manufactured in many styles. They are a woven fabric type materials that can be sewn together in plies to increase strength and are supplied in variable widths. They can be eye to eye with either sewn or attached metal ends, or a reverse eye which changes orientation of the eye in relationship to the body. They also can be sewn together to create a continuous loop type sling. Such slings are generally used for lighter loads. Examples of synthetic fiber slings are disclosed in U.S. Pat. Nos. 4,850,629, 5,492,383, 5,836,631, 6,508,051, 7,658,423, 7,661,737 and 7,669,904.

SUMMARY OF THE INVENTION

The present invention is directed to a rigging or sling system for carrying and positioning a heavy load and wherein synthetic fibrous sling units are connected to the load in a plurality of places so that balance and equilibrium are obtained. In accordance with the invention, each unit has a synthetic sling directed over a roller so that the load is distributed through the sling to the roller. As the load is rotated or tilted, the sling shortens on one side while lengthening on the other side, and the corresponding angle of the sling to the load will change accordingly while maintaining equal loading at the attachment points to the load regardless of the angle of the slings with respect to the load. The sling units may be arranged in a single or multiple arrays, and each sling unit is attached to the load at two points. This allows for unlimited arrays in both the horizontal and vertical directions. For example, a two by two array of horizontal connection points to the load requires two roller and associated sling units, and the rollers are connected to a lifting device such as a crane hook or a load beam attached to a crane hook. In this configuration, a load can be lifted, and each attachment point will have an equal portion of the load based on its relationship to the center of gravity of the load. By increasing the number of sling units in a vertical direction, the number of attachment points can be increased, while evenly distributing the load. Thus, an array of four by two sling systems requires two primary rollers and four secondary rollers, whereas a four by four array requires two primary rollers, four secondary rollers and eight tertiary rollers.

The present invention provides for sling systems of different configurations with rollers for using slings having a single path, a twin path or a combination. An eye to eye type synthetic sling requires only a single roller unit with the sling passing over the roller and having two eyes attached to the load. A continuous endless loop sling unit requires multiple roller units, one end unit at each point of connection to the load and one double roller unit between the end units. After a load is lifted where all connection points to the load are at the same level, only a small force is required to tilt the load to a position where the connection points are located with one over the top of the other thereby placing the load in a vertical position while maintaining an equal force at each connection point to the load. If desired, a locking mechanism may be used with any of the rollers so that the load is stabilized from further rotation. This can be done either manually, automatically or by a predetermined stop on the sling.

A sling system constructed in accordance with the present invention provides a number of advantages over existing sling systems. For example, the sling units provide for a significant weight reduction by using lightweight synthetic slings which are more flexible and permit a significant lower roller diameter to sling thickness ratio. The substantially lighter weight sling system, including the lighter weight and smaller diameter rollers, may be as much as 80% lighter and is also safer, easier and faster to install and further results in less likelihood of an injury to an operator. The sling system also provides for better distribution of the loads due to the fact that length tolerances are better controlled using synthetic slings which have less stretch under load and are able to maintain their required lengths after many uses. The synthetic sling and roller system of the invention further provides for a substantial cost savings over currently used sling systems.

Other features and advantages of the invention will be apparent from the following description, the accompanying drawings and the appended claims.

DESCRIPTION OF THE PREFERRED EMBODIMENTS

Figure 1:
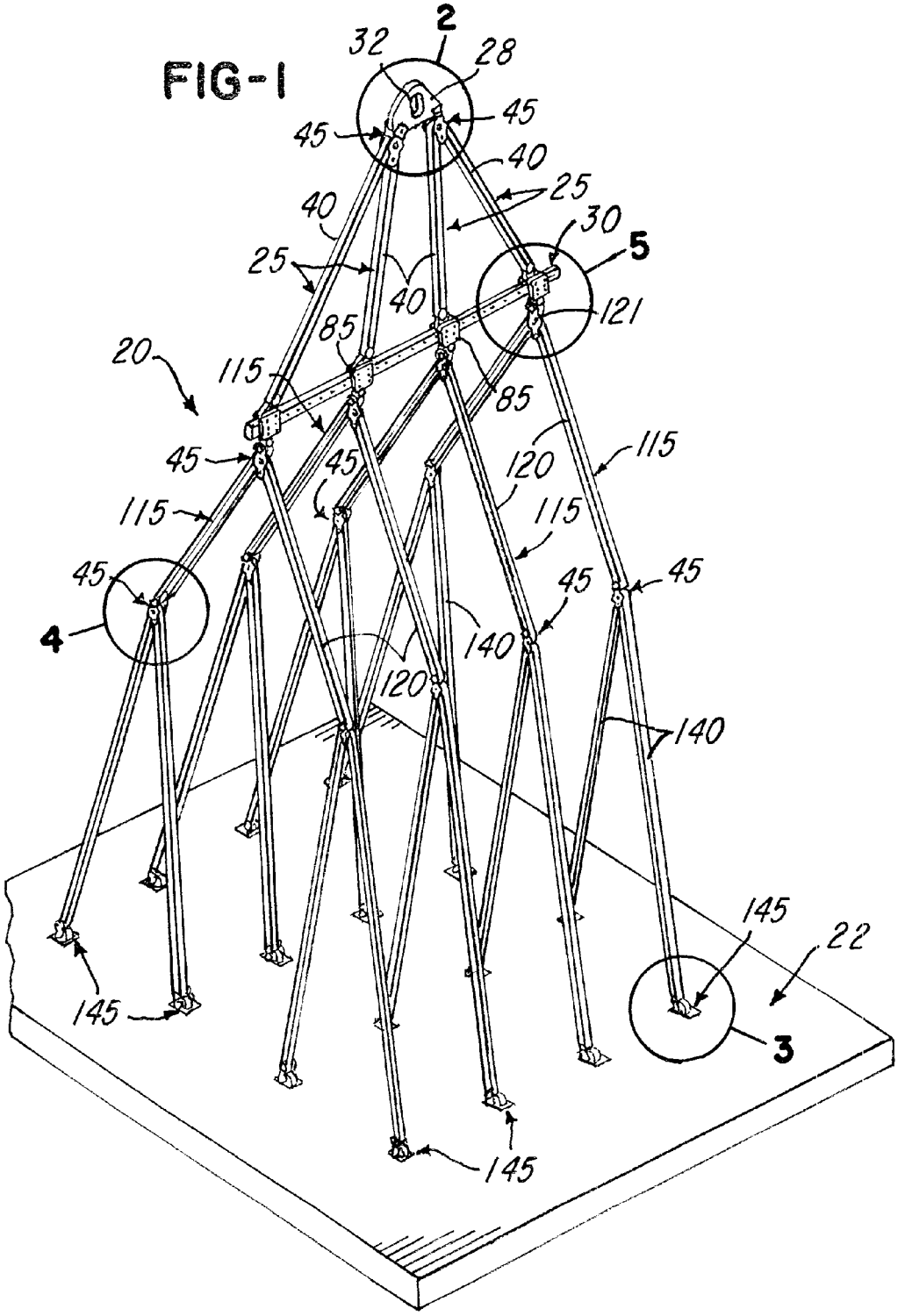
FIG. 1 is a perspective view of a sling system constructed in accordance with the invention and showing its use for lifting, transporting and tilting a heavy object in the form of a precast reinforced concrete wall panel.

Referring to FIG. 1, a sling system 20 constructed in accordance with the invention is ideally suited for lifting, transporting and tilting a heavy object such as a horizontal reinforced concrete panel 22 which is commonly precast on a horizontal concrete floor and later lifted, tilted to a vertical position and positioned to form a wall panel for a single or multi-story tilt-up building. However, a sling system constructed in accordance with the invention may be used for lifting and maneuvering any form of heavy object with the aid of a lifting device such as a mobile crane. In accordance with the invention, a plurality of upper sling units 25 are used to connect an adaptor member or plate 28 to a horizontal elongated spreader beam 30. The adaptor plate 28 has a slot or opening 32 (FIG. 2) for receiving a crane hook (not shown), and the spreader beam 30 (FIG. 5) is preferably formed of square tubular metal or steel has horizontally spaced adjustment holes 34. Each of the sling units 25 includes a continuous and endless loop flexible sling 40 in the form of a flexible synthetic fibrous sling having a cross-sectional width substantially greater than its cross-sectional thickness when directed over a roller. One form of sling material which has provided satisfactory results is manufactured by Lift-All Company, Inc. in Landisville, Pa. and sold under the trademark TUFLEX. This continuous loop synthetic fibrous sling commonly uses a tubular flexible jacket which encloses an intermediate portion of the sling, and forms lifting eyes at opposite end portions of the sling or the jacket may be omitted.

Figure 9:
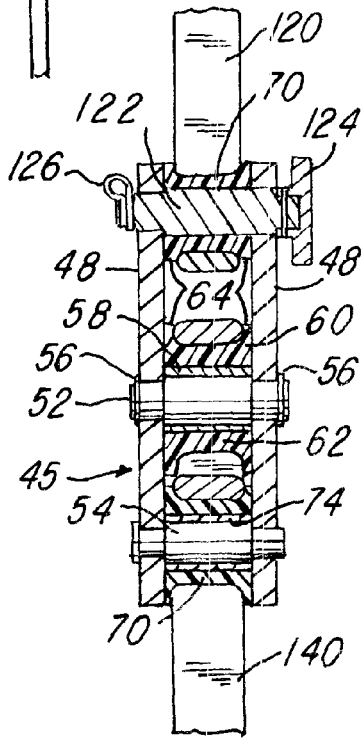
FIG. 9 is a vertical section taken generally on the line 9-9 of FIG. 8.

Each of the sling units 25 also includes a double roller assembly or unit 45 (FIGS. 1 & 2) which connects each endless loop sling 40 to the lift plate 28 or other sling to interface with a single or duplex type crane hook. Each of the double roller units 45 includes a housing formed by a pair of side plates 48 (FIGS. 2, 4 & 6-9), and the side plates are rigidly connected by a set of shafts 52 and 54. Each of the shafts has opposite end portions of reduced diameter and is secured to the side plates 48 by snap-type retaining rings 56 (FIG. 9) or other forms of fasteners. The shaft 52 supports a cylindrical bearing 58 which is secured to a spool-like roller 60 preferably molded of a rigid plastics material with the bearing 58 as an insert. As shown in FIG. 9, the roller 60 has a generally cylindrical center portion 62, but may be convex or concave, which integrally connects opposite end flanges 64 of larger diameter so that the flexible sling 40 is captured and confined by the roller and opposite edge surfaces of the sling do not contact the side plates 48.

Figure 2:
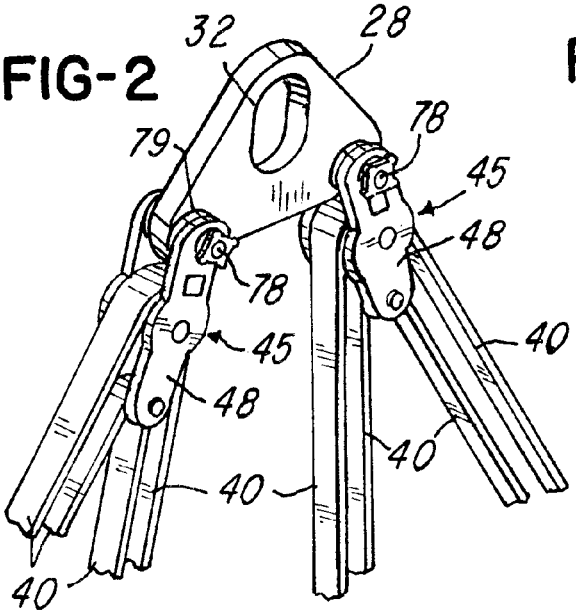
FIG. 2 is an enlarged fragmentary perspective view of the portion of the sling system shown in circle 2 of FIG. 1.
Figure 7:
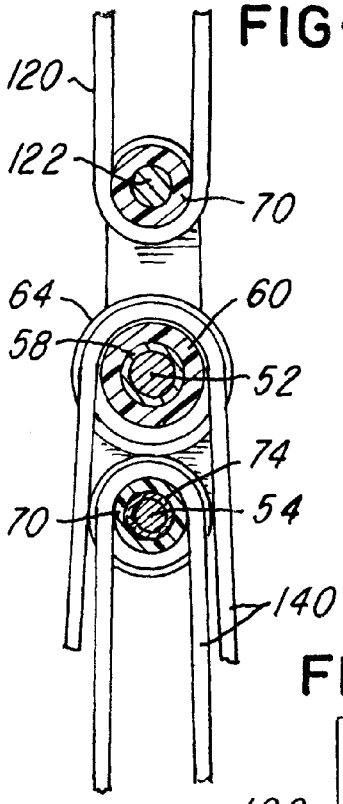
FIG. 7 is a fragmentary vertical section taken generally on the line 7-7 of FIG. 6.
Figure 8:
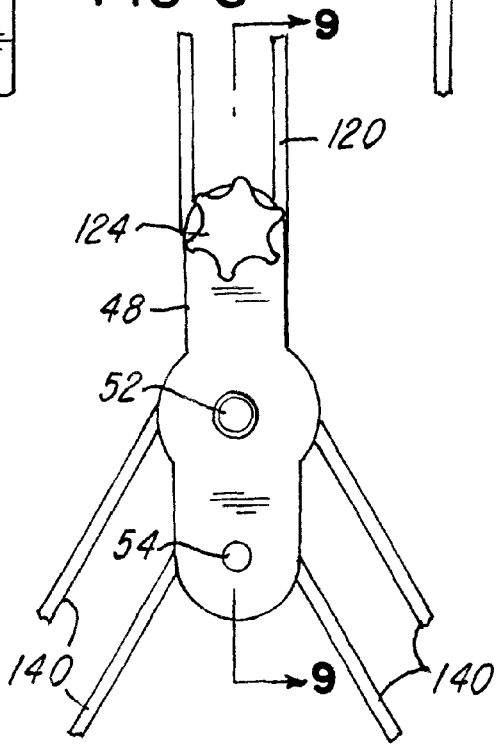
FIG. 8 is a side elevational view of the portion of the sling system shown in FIG. 6.

Another spool-like roller 70 (FIG. 9) is constructed the same as the roller 60 but is smaller in diameter and is also molded with a metal bearing 74 as an insert within the roller 70. As shown in FIG. 7, the lower roller 70 is sufficiently smaller than the upper roller 60 so that portions of the endless sling 40 may loop or extend substantially 180 degrees around each of the rollers 60 & 70. As shown in FIG. 2, the upper end portions of the side plates 48 are connected to the lift plate 28 by a cross-pin 78 extending through a bearing 79 within the plate 28 and secured by a cotter pin.

Figure 5:
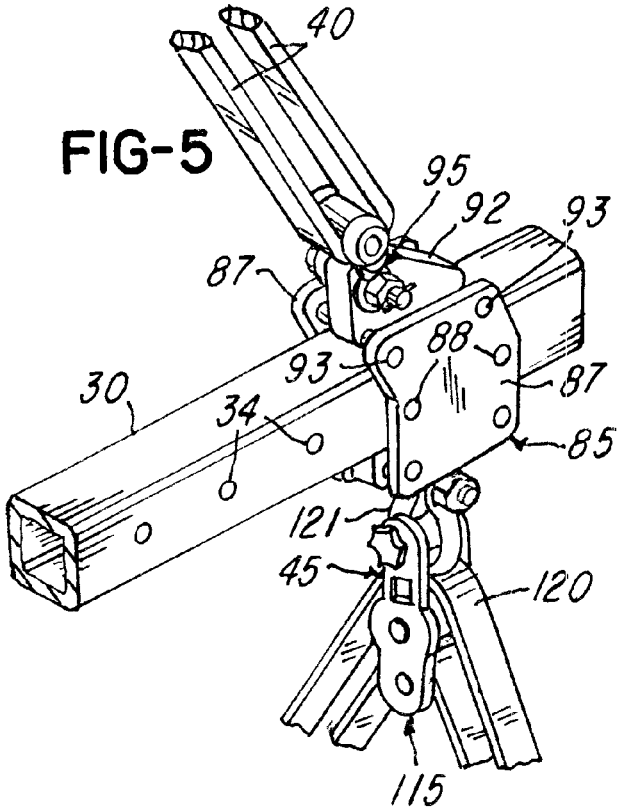
FIG. 5 is an enlarged fragmentary perspective view of the upper portion of the sling system shown in circle 5 Of FIG. 1.
Figure 6:
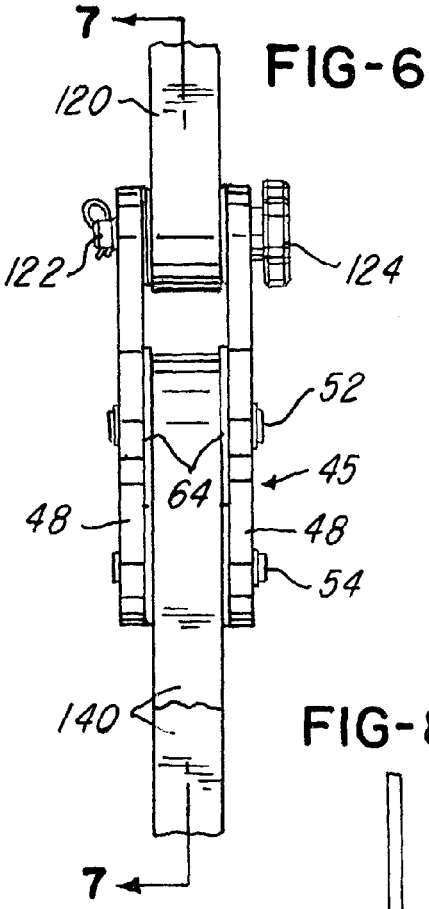
FIG. 6 is an elevational view of the portion of the sling system shown in FIG. 4.
Figure 13:
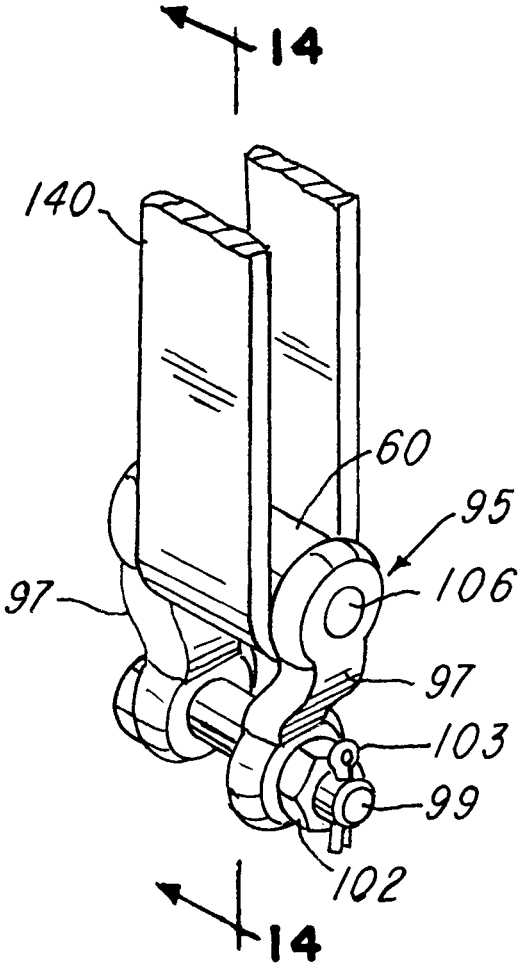
FIG. 13 is a fragmentary perspective view of a roller shackle and sling assembly as shown in FIG. 3.
Figure 14:
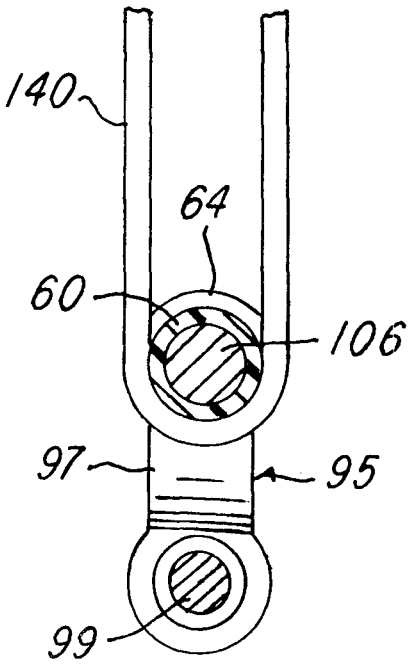
FIG. 14 is a vertical section of the shackle and sling assembly, taken generally on the line 14-14 of FIG. 13.

Referring to FIG. 5, opposite end portions of each of the two endless synthetic slings 40 are connected to the spreader beam 30 by a pair of adjustable brackets 85 each including a pair of parallel spaced side plates 87 having a pair of cross-pins 88 or bolts extending through aligned holes within the side plates 87 and the spreader beam 30. A vertical plate 92 is rigidly connected to each pair of side plates 87 by cross-pins 93 or bolts, and a single roller shackle 95 (FIGS. 5 & 13) connects each plate 92 to the endless synthetic sling 40, as shown in FIG. 5. As shown in FIG. 13, each of the shackles 95 includes a pair of flat or formed side plates 97 having lower end portions with aligned holes receiving a cross-pin or bolt 99. The bolt 99 also extends through an aligned hole within the vertical plate 92 and receives a nut 102 and retaining cotter pin 103. The upper end portions of the side plates 97 receive a cross-pin 106 (FIG. 14) which receives a spool-like roller 60 around which a longitudinal portion of the sling 40 extends about 180 degrees.

As apparent from FIG. 1, as a result of the pair of sling units 25, including the endless synthetic slings 40 and their connections to the lift plate 28 and the spreader beam 30 by the double roller units 45 and the single roller shackles 95, any load on the spreader beam 30 is uniformly distributed or equalized on each leg of each endless loop synthetic sling 40 with the spreader beam 30 remaining horizontal at all times when being lifted by a crane hook connected to the adaptor plate 28. This permits the use of a lighter weight tubular spreader beam.

Referring to FIG. 1, a set of four sling units 115 extend downwardly from the spreader beam 30 in parallel spaced planes perpendicular to the spreader beam. Each of the units 115 also includes an endless loop synthetic fibrous sling 120 which is constructed substantially the same as the endless loop sling 40 except longer in length. Each of the flexible slings 120 is connected to each of the adjustable brackets 85 (FIG. 5) by a downwardly projecting welded plate 92, a U-shaped shackle 121 and a double roller unit 45. The lower end portions of each endless loop sling 120 receives an upper spool-like roller 70 (FIG. 9) which is supported by the upper end portions of the side plates 48 of a double roller unit 45. The upper or top roller 70 on each unit 45 is rotatably supported a cross shaft 122 (FIG. 9) including a handle member 124 secured to one end portion of the shaft which has an opposite end portion receiving a retaining cotter pin 126.

Figure 3:
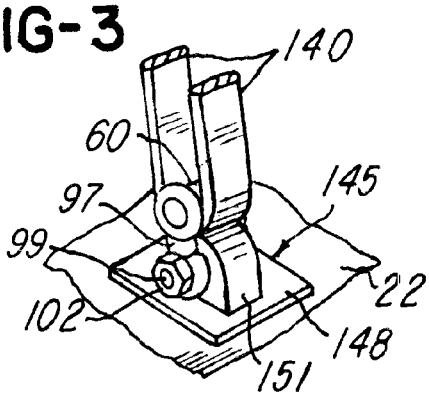
FIG. 3 is an enlarged fragmentary perspective view of the portion of the sling system shown in circle 3 of FIG. 1.
Figure 4:
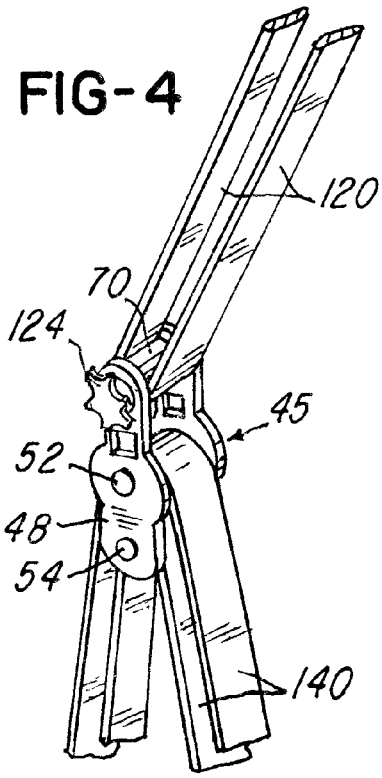
FIG. 4 is an enlarged fragmentary perspective view of the portion of the sling system shown in circle 4 of FIG. 1.

Referring again to FIG. 1, each of the double roller units 45 with a top roller 70 connected to an endless loop sling 120, also receives a lower sling unit including an endless loop synthetic fiber sling 140 which is constructed substantially the same as the endless loop slings 40 & 120, except that the sling 140 is longer in length, and there are eight sling units. As shown in FIG. 3, each of the lower end portions of each sling 140 is connected by a single roller shackle 95 to an attachment member 145 having a base plate 148 secured by anchor members (not shown) welded to the plate 148 and projecting downwardly into the precast reinforced concrete panel 22. A vertical projection or plate 151 is welded to the base plate 148 and has a cross hole which receives a shackle bolt 99 as shown in FIG. 13.

Figure 10:
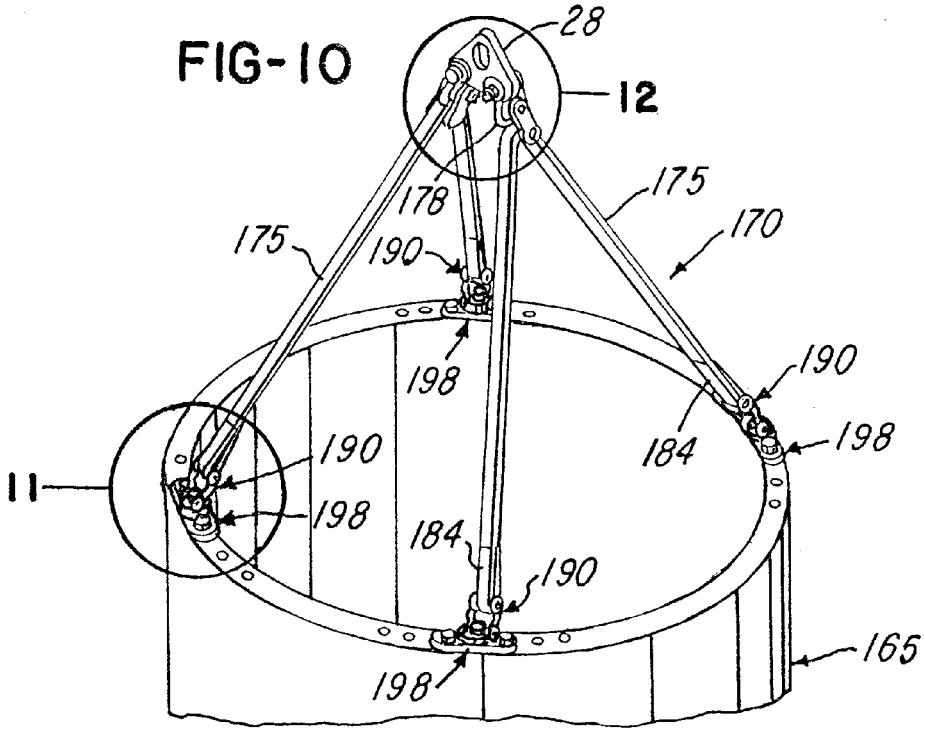
FIG. 10 is a perspective view of a sling system constructed in accordance with another embodiment of the invention for lifting and transporting a heavy object such as a precast concrete tower section.
Figure 11:
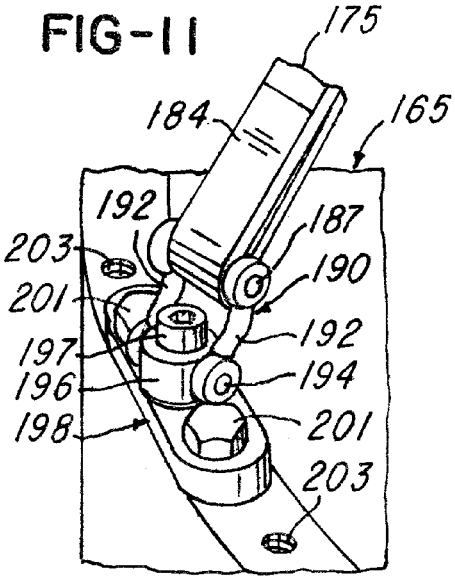
FIG. 11 is an enlarged fragmentary perspective view of the sling system within the circle 11 in FIG. 10.
Figure 12:
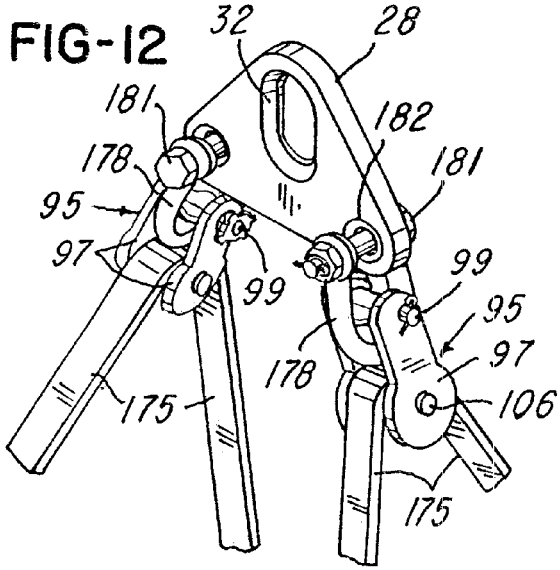
FIG. 12 is an enlarged fragmentary perspective view of the sling system shown in the circle 12 of FIG. 10.

Referring to FIG. 10, a sling system constructed in accordance with the invention may also be used for lifting and transporting a heavy object such as a cylindrical tower section 165 used for erecting a vertical tower for supporting a wind turbine. In accordance with this embodiment, a sling system 170 comprises a pair of sling units each including a flexible endless loop synthetic fiber sling 175 which extends over the roller 60 of a single roller shackle 95 (FIG. 12) having side plates 97 receiving a cross-bolt or pin 99. The cross-pin 99 extends through an inverted U-shaped non-roller shackle 178 having opposite end portions connected to the lift plate 28 by a cross-bolt 181 extending through a bushing 182 within the lift plate 28. The lower end portions of each sling 175 have conventional end loops or eye portions 184 (FIG. 11) each of which receives a cross-pin 187 of a non-roller shackle 190.

Each of the shackles 190 has side plates 192 pivotally connected by laterally aligned cross pins 194 extending into a swivel ring or collar 196 which rotates about the axis of a screw 197 connected to a tower bracket 198. The bracket 198 has horizontal base flanges secured to the tower section 165 by a pair of bolts 201 threaded into anchor tubes or fittings 203 embedded in the upper end portion of the tower section 165. As apparent from FIGS. 10 & 12, the roller shackles 95 and the synthetic slings 175 provide for evenly distributing or equalizing the load or weight of the tower section 165 or other heavy object and significantly reduce the weight of the sling system 170. The tower section 165 may be shipped with a horizontal axis and by use of the sling system 170, including the swivel shackles 190, and be rotated by a crane to a vertical position with a vertical axis, as shown in FIG. 10.

As apparent from the drawings and the above description, a sling system constructed in accordance with the present invention provides desirable features and advantages. For example, the sling system provides all of the advantages referred to above. The sling system of the invention is also modular in that any number of combinations of components may be used with the synthetic slings, including a single roller unit, a double roller unit, and non-rolling and rolling shackles.

While the sling systems herein described and their method of use constitute preferred embodiments of the invention, it is to be understood that the invention is not limited to the precise forms of sling systems described, and that changes may be made therein without departing from the scope and spirit of the invention as defined in the appended claims.

What is claimed is:

1. A sling system adapted for lifting, transporting and tilting a heavy object, said sling system comprising an inverted V-shape sling unit including an upper roller assembly, a first roller supported for free rotation within said upper roller assembly of said sling unit, a second roller supported for free rotation within said upper roller assembly below said first roller, said sling unit including an elongated continuous flexible synthetic fibrous endless sling having a cross-sectional width substantially greater than its cross-sectional thickness, said endless sling having longitudinally spaced U-shape portions extending partially around said first roller and partially around said second roller, said sling unit further including a lower second roller assembly and a lower third roller assembly each having a roller supported for free rotation, said roller of said second roller assembly and said roller of said third roller assembly each receiving a U-shape portion of said endless sling, and said second roller assembly and said third roller assembly of said sling unit being spaced apart and adapted to be connected to said object.

2. A sling system as defined in claim 1 and including a horizontal elongated spreader beam, a lift member adapted to be connected to a mobile crane hook, said upper roller assembly connected to said lift member, and said second roller assembly and said third roller assembly connected to said spreader beam at horizontally spaced locations on said beam.

3. A sling system as defined in claim 2 and including a first plurality of said sling units below said spreader beam, and said upper roller assembly of each of said plurality of sling units is connected to said spreader beam.

4. A sling system as defined in claim 3 and including a second plurality of said sling units disposed below and connected to said first plurality of sling units.

5. A sling system as defined in claim 1 wherein said second roller assembly and said third roller assembly each comprises a shackle including said roller supported for free rotation, and each said shackle includes pivotally supported spaced side plates supporting said roller.

6. A sling system as defined in claim 1 wherein said second roller within said upper roller assembly of said sling unit is smaller in diameter than said first roller.

7. A sling system adapted for lifting, transporting and tilting a heavy object, said sling system comprising a plurality of inverted V-shape sling units each including an upper roller assembly including a roller supported for free rotation, each of said sling units further including a lower second roller assembly and a lower third roller assembly each having a roller supported for free rotation, said second roller assembly and said third roller assembly of each of said sling units being spaced apart and adapted to be connected to said object, each of said sling units including an elongated continuous flexible synthetic fibrous endless sling having a cross-sectional width substantially greater than its cross-sectional thickness, said endless sling of each of said sling units having longitudinally spaced U-shape portions extending partially around said roller of said upper roller assembly and said roller of said second roller assembly and said roller of said third roller assembly, and a lift member connected to said upper roller assembly of each of said sling units by a corresponding shackle.

8. A sling system adapted for lifting, transporting and tilting a heavy object, said sling system comprising a plurality of inverted V-shape sling units each including an upper roller assembly including a roller supported for free rotation, each of said sling units further including a lower second roller assembly and a lower third roller assembly each having a roller supported for free rotation, said second roller assembly and said third roller assembly of each of said sling units being spaced apart and adapted to be connected to said object, each of said sling units including an elongated one-piece continuous flexible synthetic fibrous endless sling having a cross-sectional width substantially greater than its cross-sectional thickness, said endless sling of each of said sling units having longitudinally spaced U-shape portions extending partially around said roller in said upper roller assembly, said roller of said second roller assembly and said roller of said third roller assembly of each of said sling units each receiving a U-shape portion of said endless sling, each said U-shape portion of said elongated continuous flexible synthetic fibrous endless sling of each of said sling units being movable longitudinally relative to the corresponding said roller and longitudinally relative to every other U-shape portion of said sling, and a lift member connected to said upper roller assembly of each of said sling units by a corresponding shackle.

9. A sling system as defined in claim 8 wherein said second roller assembly and said third roller assembly of each of said sling units each comprises a shackle including the corresponding said roller supported for free rotation, and each said shackle includes pivotally supported spaced side plates supporting said roller.

* * * * *